United States Patent [19]

Ridgeway

[11] 4,160,413

[45] Jul. 10, 1979

[54] SHAPED EXPLOSIVE CHARGE DEVICE FOR UNDER WATER USE

[75] Inventor: John J. Ridgeway, Aix-en-Provence, France

[73] Assignee: Imperial Chemical Industries Limited, London, England

[21] Appl. No.: 835,285

[22] Filed: Sep. 21, 1977

[30] Foreign Application Priority Data

Oct. 20, 1976 [GB] United Kingdom ..... 43516/76

[51] Int. Cl.[2] ..... F42B 3/08

[52] U.S. Cl. ..... 102/24 HC

[58] Field of Search ..... 102/20, 24 HC, DIG.9, 102/23

[56] References Cited

U.S. PATENT DOCUMENTS 2,869,825 1/1959 Crawford ..... 102/20

3,109,373 11/1963 Saffler ..... 102/24 HC 3,855,929 12/1974 Ridgeway ..... 102/24 HC

FOREIGN PATENT DOCUMENTS 1087061 12/1959 Fed. Rep. of Germany ..... 102/23

*Primary Examiner*—Verlin R. Pendegrass

*Assistant Examiner*—E. F. Miles

*Attorney, Agent, or Firm*—Cushman, Darby & Cushman

[57] ABSTRACT

In the use of a shaped explosive charge device underwater, the stand-off and cavity chamber are filled with compressed gas which is fed into the chamber to expel water through one or more apertures communicating with the surrounding water. Conveniently the apertures remain open and the compressed gas is entrapped and maintained within the device by the ambient hydrostatic pressure.

9 Claims, 1 Drawing Figure

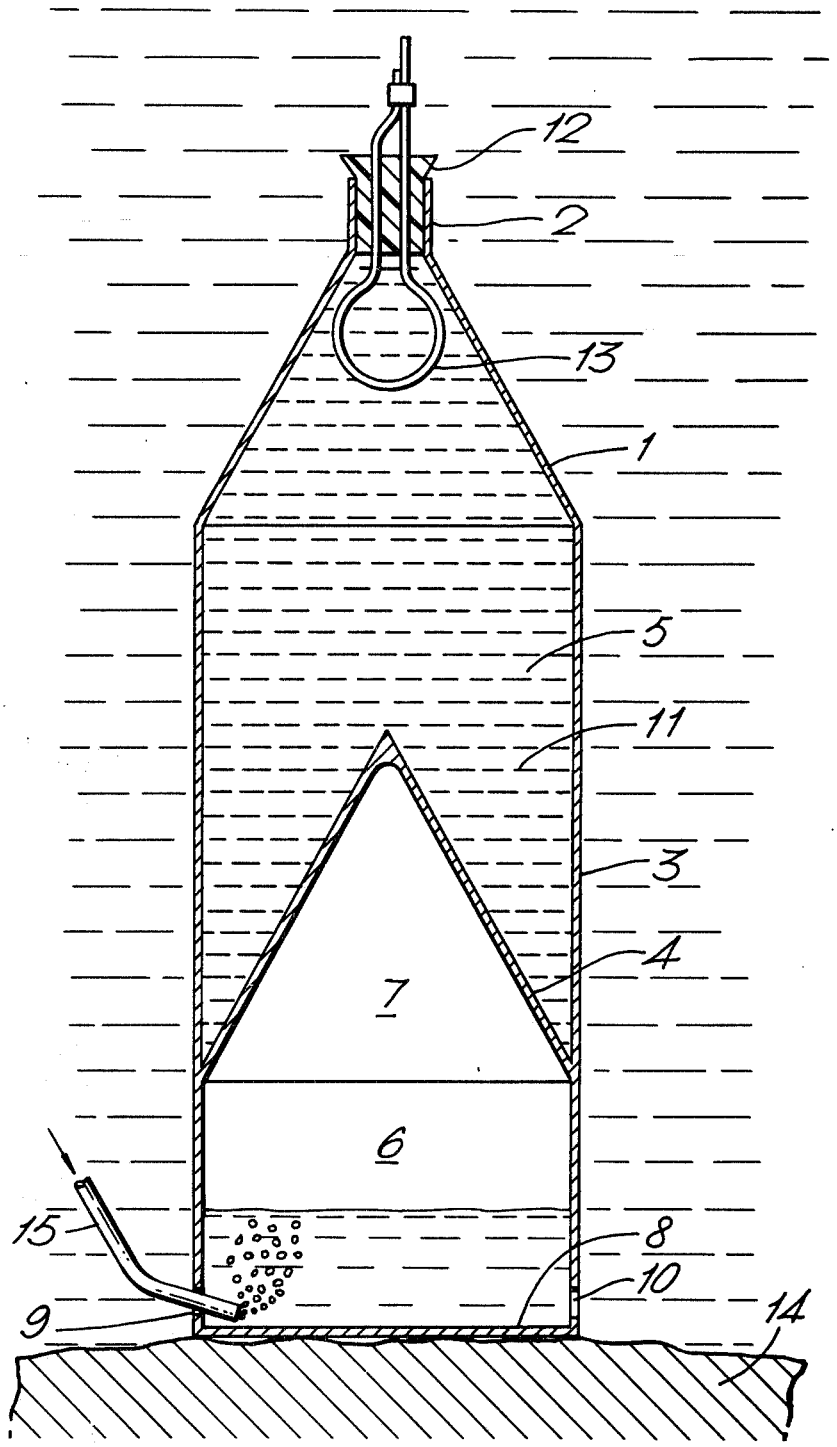
12
2
13
1
5
11
3
4
7
6
15
8
10
9
14

SHAPED EXPLOSIVE CHARGE DEVICE FOR UNDER WATER USE

This invention relates to a method of using a shaped explosive charge device for underwater blasting and to a shaped explosive charge casing and a shaped explosive charge device for said method.

Shaped explosive charges are designed to produce a focussed shockwave of great penetrating power directed outwardly along the axis of an outwardly divergent cavity in one face of the charge. The cavity is usually conical, frusto-conical or sphero-conical. The cavity cross-section parallel to the base may be circular but, in elongated shaped charges used for linear and curvilinear cutters, it will be rectangular or other elongate form. The explosive composition is usually disposed symmetrically with respect to the cavity axis. In use the shaped charge is placed with the base of the cavity facing towards a target surface and at an optimum distance, termed the stand-off, for maximum cutting effect. Usually the cavity is lined with metal to enhance the penetrating power.

The casing of the shaped charge device generally extends beyond the base of the cavity of the explosive charge to provide the required stand-off between the base of the explosive charge and the base of the casing. In devices for underwater use the cavity and stand-off space are sealed to exclude water because any dense material in this space reduces the shockwave power. Thus an underwater shaped charge device generally has a sealed charge casing divided into an explosive charge compartment and a combined cavity stand-off compartment, the compartments being separated by a cavity liner presenting a concave surface within the stand-off compartment.

For blasting and demolition work on the sea bed the shaped charge casing is required to be sufficiently strong to withstand the external hydrostatic pressure in order to prevent water leakage into the stand-off campartment. The casing is therefore usually fabricated from several parts of heavy gauge steel sheets appropriately formed to shape and welded at seams and corners. Since the amount of distortion and the effects of any distortion must be minimal the quality of the materials and the quality of the jointing must be of a high order and the casings are necessarily expensive. For depths below 100 meters the amount of reinforcement of the stand-off chamber or the thickness of steel required for the casings is so great that the cost of shaped charge devices makes their use impracticable.

It is an object of this invention to provide a method of using shaped explosive charge devices underwater, wherein a cheaper shaped explosive charge device can be used. A further object is to provide a method of using conventional shaped explosive charges at greater depths.

We have now discovered that the cavity and stand-off space of a shaped charge device can advantageously be left unsealed so that when submerged in water the pressure in the cavity and stand-off space remains equal to that of the surrounding water and any water which enters this space can be expelled be feeding compressed gas, for example, air or nitrogen, into the space. The required supply of compressed gas is normally readily available to a diver when he is preparing the devices for blasting. With this method of using shaped charge devices pressure differences between the interior and the surroundings can be avoided and weaker structural materials can, therefore, be used.

Thus in accordance with the invention, in the use of a shaped explosive charge device underwater the cavity and stand-off space are filled with gas at a pressure which is not less than the hydrostatic pressure at the depth of use. Preferably the cavity and stand-off space are in direct communication with the surrounding water so that the water pressure is transmitted directly to the gas.

In one particularly advantageous mode of practising the invention a shaped charge device having communicating cavity and stand-off spaces sealed from the external surroundings, except for one or more apertures at the bottom of the stand-off space, is submerged and lowered into position on an underwater target surface, and compressed gas at a pressure exceeding the ambient hydrostatic pressure is fed through an aperture into said stand-off space until substantially all the water is expelled and said space is substantially filled with gas, which gas thereafter remains entrapped in the stand-off space by the pressure of the surrounding water acting thereon, said pressure being transmitted through said aperture.

The invention also includes a casing for a shaped explosive charge device for underwater use, which casing defines a compartment for the shaped explosive charge, and a cavity space and stand-off space for said explosive charge, said casing having at least one fluid permeable aperture through which external water pressure may be transmitted to said spaces and compressed gas may be fed into said spaces and retained in said spaces under pressure. The invention also includes a shaped explosive charge device comprising said casing containing an explosive charge.

In a preferred device of the invention the casing comprises an external housing divided transversely by a metal cavity liner element into first and second compartments, said first compartment being adapted to contain a shaped explosive charge in intimate contact with said liner element, said second compartment providing cavity and stand-off space for said explosive charge, said liner element presenting a convex surface to said explosive charge and a concave surface to said second compartment, and at least one aperture in said housing providing a passage for fluid pressure transmission to said second compartment from water surrounding the casing.

Preferably the housing has at least two apertures leading to the second compartment whereby compressed gas can be fed through one aperture and water can be expelled through the other aperture or apertures. It is also preferred that the apertures should be positioned near to the bottom of the housing so that the maximum gas volume will be retained without the need for any closure device on the apertures.

The explosive charge is advantageously a liquid explosive which, because it is substantially incompressible, supports that part of the casing in which it is contained.

Preferably the explosive composition is one which can be prepared from two or more components by simple mixing at the blast site. A preferred composition comprises nitroparaffin and amine as the separate components, the preferred nitroparaffin comprising nitromethane, nitroethane or nitropropane and the preferred amine comprising ethylene diamine or benzylamine.

The invention is further illustrated by the shaped charge device hereinafter described, by way of example only, with reference to the accompanying drawing which shows diagrammatically the device in medial sectional elevation being prepared for blasting on a submerged rock bed.

The device, which is circular in plan, comprises a container having a frusto-conical shoulder portion 1 between a cylindrical neck 2 and a cylindrical body portion 3. A metal cone 4, serving as the cavity liner for the shaped charge, is attached by a fused peripheral joint to the interior surface of the body portion 3 at a distance from the end to divide the interior of the container into a chamber 5 for the explosive charge and a second chamber providing stand-off space 6 and a conical cavity 7. The bottom of the container is provided with an end plate 8. Two diametrically opposed apertures 9 and 10 are formed in the body portion 3 near to the end plate 8. The chamber 5 contains a liquid explosive charge 11 which surrounds the metal cone 4, the cavity 7 being the cavity of the shaped charge.

The explosive charge is mixed immediately before use and loaded through the neck 2, the neck being then closed with a stopper 12 through which a priming loop 13 of detonating cord is threaded.

In use the device is weighted by the attachment of ballast (not shown), which is usually concrete, and submerged to rest on a rock bed 14. Compressed air at a pressure exceeding the ambient water pressure is then fed through a feed pipe 15 extending through the aperture 9 into the stand-off space 6 until all the water is expelled from spaces 6 and 7 and air bubbles emerge from aperture 10. The apertures 9 and 10 could, if desired, be sealed with a valve closure, but for normal use with the device in an upright position the external water provides adequate sealing. The pressure in the stand-off space 6 and the cavity 7 therefore is always approximately equal to the surrounding water pressure and, since the explosive charge 11 is substantially incompressible, the container is not subjected to excessive stress at any point. The container can therefore be constructed from lightweight materials such as light mild steel sheet or synthetic plastics material.

What we claim is:

1. A casing for a shaped explosive charge device for underwater use, said casing defining a compartment for the shaped explosive charge and a cavity space and stand-off space for said explosive charge, said spaces being in communication with ambient fluid pressure, and means for introducing gas under a pressure higher than the ambient pressure when said casing is submerged, so that water will be expelled and so that the gas will be retained in said spaces.

2. A casing as claimed in claim 1 comprising an external housing divided transversely by a metal cavity liner element into first and second compartments, said first compartment being adapted to contain a shaped explosive charge in intimate contact with said liner element, said second compartment providing cavity and stand-off space for said explosive charge, said liner element presenting a convex surface to said explosive charge compartment and a concave surface to said second compartment, and at least one aperture in said housing providing a passage for fluid pressure transmission to said second compartment from water surrounding the casing.

3. A casing as claimed in claim 2 wherein the housing has at least two apertures leading to the second compartment whereby compressed gas can be fed through one aperture and water can be expelled through the other aperture or apertures.

4. A casing as claimed in claim 3 wherein the apertures are positioned near to the bottom of the housing.

5. A shaped explosive charge device for underwater use comprising a casing as claimed in claim 1 inclusive containing a substantially incompressible explosive charge.

6. A shaped explosive charge device as claimed in claim 5 wherein the explosive charge comprises liquid explosive.

7. A shaped explosive charge device as claimed in claim 5 wherein the explosive comprises a two-component explosive composition.

8. A method of underwater blasting comprising submerging and lowering into position a shaped explosive charge device having a downwardly-facing cavity and a stand-off space which are in direct communication with the surrounding water, introducing gas into the cavity and stand-off space at a pressure exceeding the ambient hydrostatic pressure to thereby expel water from the cavity and the stand-off space and entrap gas in said cavity and stand-off space, and thereafter detonating said device.

9. A method as in claim 8 wherein the water in said cavity and stand-off space are expelled through at least one aperture in a wall which seals the stand-off space from ambient hydrostatic pressure.

* * * * *